US006405540B1

(12) United States Patent
Dhellemmes

(10) Patent No.: US 6,405,540 B1
(45) Date of Patent: Jun. 18, 2002

(54) PROCESS AND SYSTEM FOR PREVENTING THE EVAPORATION OF A LIQUEFIED GAS

(75) Inventor: Jacques Dhellemmes, Versailles (FR)

(73) Assignee: Gaz Transport et Technigaz, Trappes (FR)

( * ) Notice: Subject to any disclaimer, the term of this patent is extended or adjusted under 35 U.S.C. 154(b) by 0 days.

(21) Appl. No.: 09/395,250

(22) Filed: Sep. 13, 1999

(30) Foreign Application Priority Data

Oct. 23, 1998 (FR) ..... 98 13300

(51) Int. Cl.[7] ..... F17C 5/02
(52) U.S. Cl. ..... 62/47.1
(58) Field of Search ..... 62/47.1, 240, 7

(56) References Cited

U.S. PATENT DOCUMENTS

| | | | | |
|---|---|---|---|---|
| 3,918,265 A | | 11/1975 | Etzbach et al. | 62/54 |
| 5,586,437 A | * | 12/1996 | Blecher et al. | 62/47.1 |
| 5,644,920 A | * | 7/1997 | Lak et al. | 62/47.1 |

FOREIGN PATENT DOCUMENTS

| | | |
|---|---|---|
| DE | 22 60 516 A | 6/1974 |
| DE | 24 49 442 | 4/1976 |
| DE | 25 04 384 A | 8/1976 |
| DE | 44 11 339 A | 10/1995 |
| DE | 196 20 653 C1 | 5/1997 |
| EP | 0 748 431 B1 | 5/1999 |

* cited by examiner

*Primary Examiner*—William Doerrler
*Assistant Examiner*—Malik N. Drake
(74) *Attorney, Agent, or Firm*—Connolly Bove Lodge & Hutz, LLP

(57) ABSTRACT

A device is disclosed for preventing the evaporation of a liquefied gas stored in an impervious and thermally insulating tank built into a bearing structure of a ship or located in a set of floating or land-side storage tanks. The device passes a fluid refrigerant through the mass of liquefied gas to cool the mass to a temperature slightly below its reference storage temperature. By so doing, the refrigerant compensates for the heating of the mass, due to thermal leaks within the insulating tank, during the transport or storage of the liquefied gas.

18 Claims, 2 Drawing Sheets

PROCESS AND SYSTEM FOR PREVENTING THE EVAPORATION OF A LIQUEFIED GAS

Figure 1:
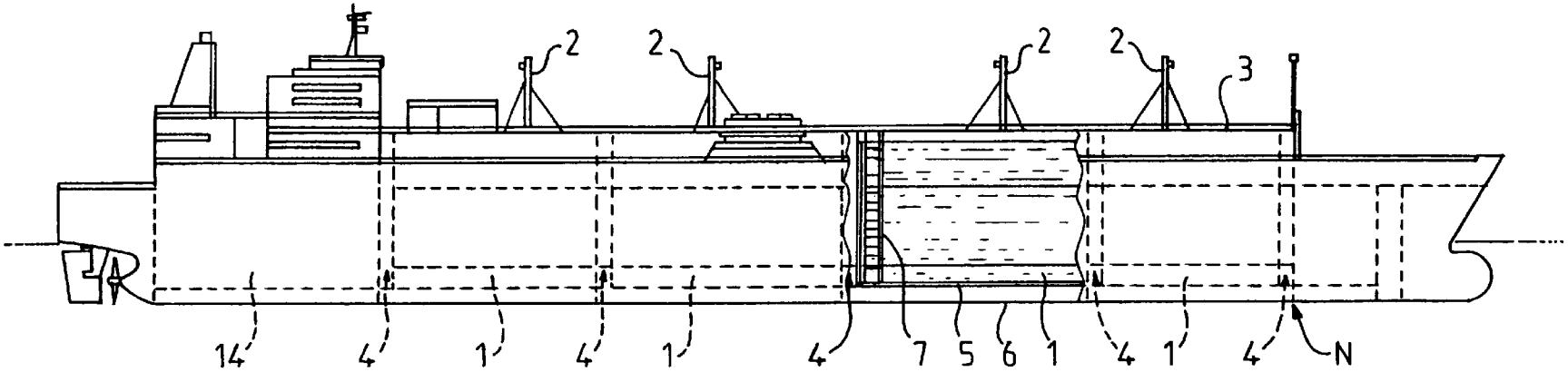

The present invention relates to a process for preventing the evaporation of a liquefied gas, particularly liquid methane, stored in an impervious and thermally insulating tank which may or may not be built into a bearing structure of a ship, particularly a methane tanker, and to the device for implementing this process.

Liquid methane is generally stored in liquid form at a pressure close to atmospheric pressure and at a temperature of around −163° C. In order to limit the evaporation of liquid methane during transport, it has already been proposed that the thermal insulation of the tank be improved, using various methods which are described in French patent applications 2 535 831, 2 586 082, 2 629 897 and 2 683 786, all of which are in the name of the Applicant Company. Improvements to the thermal insulation of the tank have made it possible to lower the nominal degree of evaporation per day of storage, from 0.30% to about 0.15%, but it is difficult to improve beyond this.

On a methane tanker, each tank is generally connected to a mast riser on the main deck of the ship, to allow the evaporated gas to escape, as this gas would otherwise generate an inadmissible overpressure in the tank. In order to avoid discharging the evaporated gas into the atmosphere, which gas constitutes pollutant emissions which are all the more unacceptable when the ship is near a port, and to avoid thus losing part of the cargo, it is known practice to use the evaporated gas to propel the ship. For this purpose, the engine room of the ship is generally equipped with a steam turbine which is adapted to run both on evaporated gas and on diesel or fuel oil. However, steam turbines have a low efficiency and the dual functionality of the turbine entails lengthening the engine room, and this means lengthening the ship or reducing the size of the storage tanks. Furthermore, with a degree of evaporation of the order of 0.15%, the evaporated gas supplies only 40 to 80% of the energy needed by the steam turbine, which therefore has to constantly run on the diesel or the fuel oil as well.

To avoid the drawback associated with burning the evaporated gases and to avoid consuming part of the cargo before it is offloaded, it has also been proposed that a reliquefaction plant be installed on the deck of the ship in order to reliquefy the evaporated gases and return them to the tank. However, this solution is extremely onerous to implement because the initial outlay for a reliquefaction plant is very high and the power requirement of a reliquefaction plant is also very high. Furthermore, as a cargo of methane is generally not pure, it is necessary to provide separate liquefaction of the various fractions of the cargo, which entails the use of separation columns, something which is difficult to manage on a ship subject to swell.

The object of the invention is to eliminate the aforementioned drawbacks and to provide a process for preventing the evaporation of a liquefied gas stored in an impervious and thermally insulating tank which may or may not be incorporated into a bearing structure of a ship and which is simple and economical to implement and to operate.

To this end, the subject of the invention is a process for preventing the evaporation of a liquefied gas stored in an impervious and thermally insulating tank built into a bearing structure of a ship or located in a set of floating or land-side storage tanks, characterized in that it consists in passing a fluid refrigerant through the mass of liquefied gas to cool said mass to a temperature slightly below its reference storage temperature, so as to compensate for the heating of said mass as a result of thermal leaks during transport or storage thereof. Thus, the evaporation of the liquefied gas is prevented, or, at the very least, limited. What happens is that if the liquefied gas begins to evaporate into the gaseous volume lying on top of the liquefied mass in the tank, the circulation of the fluid refrigerant will cause automatic reliquefaction of the evaporated gas, by heat transfer at the interface between the liquefied gas and the evaporated gas.

The invention is also aimed at a device for implementing the aforementioned process, characterized in that it comprises, for each tank, a heat exchanger immersed in the mass of liquefied gas that is to be cooled, a compressor for compressing the fluid refrigerant at the exit of the exchanger, and a refrigeration unit for cooling the compressed fluid refrigerant to its refrigeration temperature before it enters the heat exchanger.

Advantageously, the device comprises a unit for circulating sea water to cool the compressed fluid refrigerant before it enters the refrigeration unit. This sea water circulation unit may be connected to a ballast collector of a ship.

In a particular embodiment, the fluid refrigerant is in the liquid phase, is preferably liquid nitrogen, as it enters the heat exchanger and vaporizes as it passes through the mass of liquefied gas, the refrigerating unit being designed to reliquefy the fluid refrigerant each cycle. This alternative form is particularly efficient because the latent heat of the liquid refrigerant is used to refrigerate the cargo. Of course, the fluid refrigerant could be in the gaseous phase, and in this case the gaseous refrigerant undergoes a pressure reduction as it is heated in the heat exchanger, for example on the known Joule-Thomson cycle.

According to another feature, the refrigerating unit is designed to take the fluid refrigerant down to a refrigeration temperature which is approximately 30° C. below the reference temperature for the mass of liquefied gas before it enter he heat exchanger.

According to yet another feature of the invention, each tank is fitted with a pressure gage for monitoring the variations in pressure in the volume of gas lying on top of the mass of liquefied gas in the tank. In this case, the pressure gage may initiate the circulation of the fluid refrigerant as soon as the pressure detected by the pressure gage exceeds a first predetermined pressure threshold value, for example 5 mmbar [sic] above the reference storage pressure, which is generally of the order of 1,060 mmbar [sic], and stops it as soon as the detected pressure is below a second determined pressure threshold value, for example 5 mmbar [sic] below said reference pressure.

Advantageously, the heat exchanger is supported inside the tank by a tower for loading/offloading the liquefied gas, which tower is provided on one of the vertical transverse walls of the tank.

The heat exchanger may comprise one or more hairpin tubes, the ends of which pass through the roof of the tank. In this case, each hairpin tube or group of hairpin tubes may be surrounded on its sides by a hollow pipe forming a convection well, open at its two vertical ends, to generate a convective movement in the mass of liquefied gas through each well.

Advantageously, the compressor and the refrigeration unit are installed on the deck of the ship, in line with the loading/offloading tower of each tank.

In order to give a better understanding of the subject of the invention, one embodiment thereof, depicted in the appended drawings, will now be described by way of purely illustrative and non-limiting example.

Figure 2:
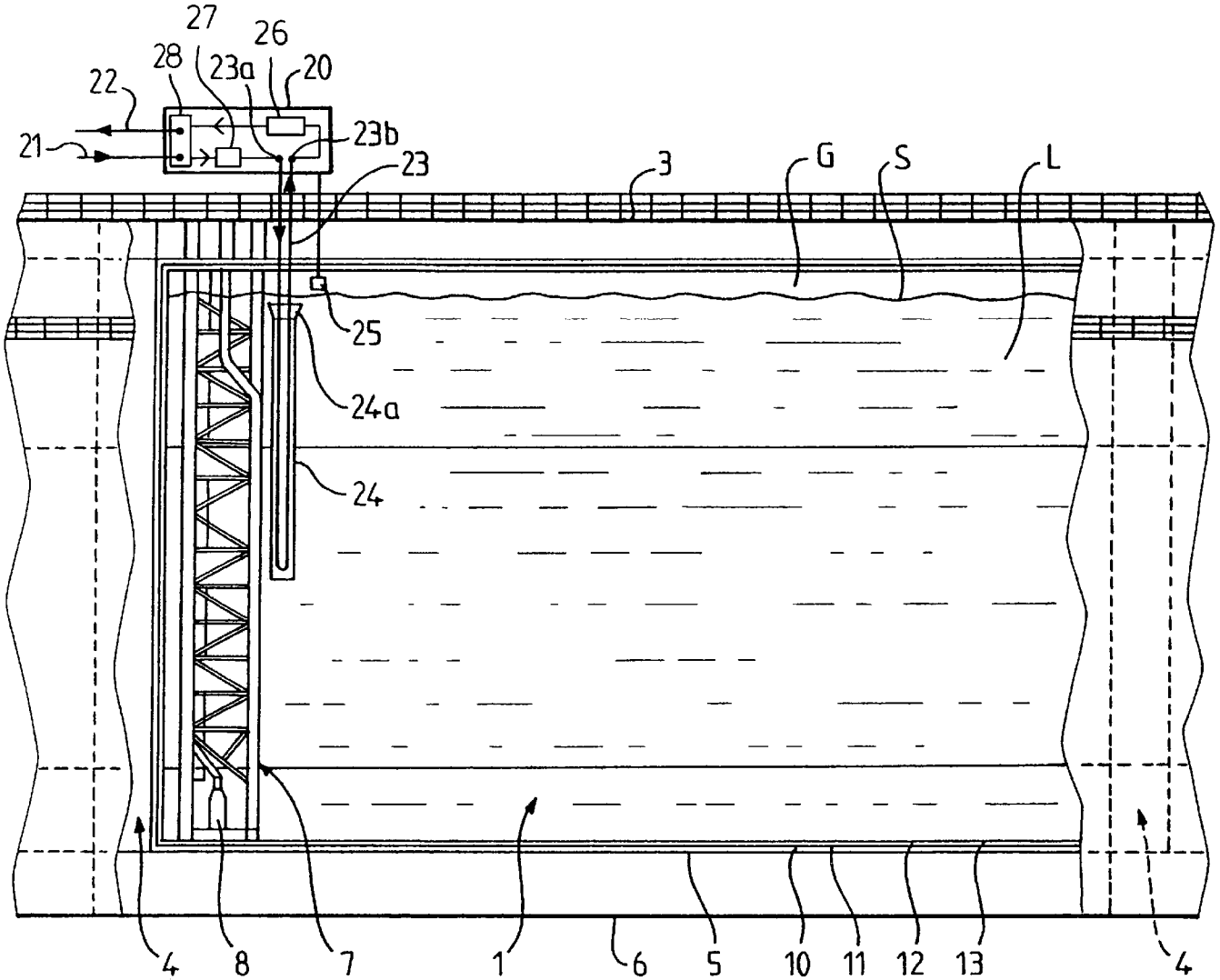

In this drawing:

FIG. 1 is a diagrammatic longitudinal elevation and part section of a methane tanker of conventional structure, and FIG. 2 is an enlarged and part-sectioned partial view of a tank of the ship of FIG. 1, in one embodiment of the invention.

FIG. 1 depicts a methane tanker N of conventional structure, which has four tanks 1 for the storage of the cargo, each tank being associated with a mast riser 2 which is provided on the main deck 3 of the ship, so that gas can escape when the pressure in the tank rises. At the stern of the ship N there is an engine room 14 which in the conventional way contains a steam turbine which operates on diesel and/or on the evaporated gas from the tanks.

The tanks 1 are separated from each other by double transverse bulkheads 4 known by the name of cofferdams. The bottom of each tank is formed by the internal surface 5 of the double hull of the ship, the space in between the internal surface 5 and the external surface 6 of the double hull serving as ballast. In a way known per se, each tank 1 contains a loading/offloading tower 7 for loading the cargo into the tank before it is transported, and for offloading the cargo once it has been transported.

As can best be seen from FIG. 2, the tower 7 extends over the entire height of the tank 1, near to a transverse bulkhead of the cofferdam 4, and at its lower part has a pump 8 for offloading the cargo. In a way known per se, the tower 7 comprises a cargo loading line and a cargo offloading line, it being possible for the tower to be of the tripod type, that is to say to have three vertical masts which support all of the lines for loading and offloading the cargo.

In a way known per se, each tank 1 comprises a secondary thermal insulation barrier 10 fixed to the bearing structure of the ship, particularly the internal surface 5 of the double hull and the transverse bulkheads 4, and two, secondary 11 and primary 12, watertightness barriers attached to said secondary insulation barrier 10. Between the secondary 11 and primary 12 watertightness barriers there is generally mounted a primary thermal insulation barrier 13 or alternatively an impact-resistant mechanical protection shield as described in French patent application 98/08196 of Jul. 10, 1998, in the name of the Applicant Company.

FIG. 2 depicts the line of separation S between the mass of liquefied gas L and the volume of the cargo in the gaseous phase G, inside the tank 1.

An overall block 20 has been used in FIG. 2 to depict a device having a refrigeration unit 27 associated with a compressor 26, for example for circulating liquid nitrogen. The refrigeration unit may be designed to reliquefy the liquid nitrogen leaving the tank. The block 20 is mounted on the main deck 3 of the ship.

An inlet line 21 and an outlet line 22 are connected to circulation unit 28, for circulating sea water originating, for example, from a ballast collector of the ship.

At least one hairpin tube 23 is connected at its inlet 23*a* and at its outlet 23*b* to the block 20. The hairpin tube 23 constitutes a heat exchanger which extends vertically down into the tank 1, to substantially mid-way from its bottom. Although this is not depicted, each hairpin tube 23 is advantageously supported by a mast of the aforementioned tower 7. For this purpose, each hairpin tube 23 extends near to the tower 7.

Around each hairpin tube 23 there is a hollow pipe 24 forming a convection well inside the tank 1. This pipe 24 is open at its two vertical ends so as to cause a convective movement of the cargo stored in the tank 1.

The operation of one embodiment of the invention will now be described.

Methane in liquid phase L and the small volume in gaseous phase G is stored in the tank 1 at a temperature of around −163° C.

The refrigeration unit 27 causes liquid nitrogen at about −196° C. to pass through the hairpin tube 23, and this has the effect of cooling the liquid methane L around said tube 23. Given that the liquid methane thus cooled becomes more dense, it sinks in the tank 1, and the liquid methane which has not yet been cooled conversely rises. This convective movement of the liquid methane L is routed through the convection well 24, so as to create this convective movement throughout the tank 1. By way of example, the diameter of the hollow pipe 24 is about 1 meter. Of course, the heat exchanger could comprise several hairpin tubes 23, or tubes with several elbows, together with several convection pipes 24. The hollow pipe 24 is substantially funnel-shaped 24*a* at its upper end, widening outward, to encourage this convective movement.

As it passes through the hairpin tube 23, the liquid nitrogen evaporates, and this allows the liquid methane L to be cooled more effectively by using the latent heat of the nitrogen. This being the case, it would also be possible to use nitrogen in the gaseous phase, the gaseous nitrogen undergoing a pressure drop as it flows through the heat exchanger. As it leaves the outlet 23*b* of the hairpin tube 23, the nitrogen is at a temperature of about −163° C. The nitrogen then flows through the compressor 26, for example a three-stage compressor, which brings the nitrogen up to a temperature of about +130° C. for example. The nitrogen thus compressed is cooled first of all by the sea water circulation lines 21, 22, within circulation unit 28 to bring the nitrogen down to a maximum temperature of about 30° C., that is to say the temperature of the sea water. Finally, the compressed nitrogen thus cooled undergoes reliquefaction in the refrigeration unit to bring it down to a temperature of −196° C.

Given that the refrigeration unit 27 and the compressor 26 are located vertically above the tower 7, it is possible to use the power available for the offloading pump 8, because the latter is not in operation during transport, only during offloading.

The block 20 is advantageously associated with a pressure gage 25 located in the gaseous volume G of the tank 1, to detect variations in pressure in this gaseous volume. By way of example, for a reference storage pressure of about 1,060 mmbar [sic] in the gaseous volume G, the pressure gage 25 is able to detect a variation of 5 mmbar [sic] above and below this reference pressure so as respectively to start up the refrigeration unit 27 and the compressor 26 or switch them off. Given that the cargo in each tank has a great deal of thermal inertia, the refrigeration unit 27 has the compressor 26 generally operate for several hours before achieving a small amount of cooling of the stored cargo, and before being able to reliquefy the methane evaporated at the interface S with the liquefied gas L. Similarly, the refrigeration unit 27 and the compressor 26 remain inactive for several hours before the liquefied gas can begin to evaporate again.

In practice, as the thermal losses resulting from irradiation of the deck occur essentially by day, it is possible to have the compressor 26 and refrigeration unit 27 running automatically by day and switching off at night.

By virtue of the invention, it is possible to dispense with the steam turbine for propelling the ship and to use a diesel engine running on diesel fuel, which has better efficiency and takes up less space, which makes it possible to reduce the size of the engine room. The size of the engine room can be reduced by about 10%, which amounts to a length several meters shorter. Now, each meter saved from the engine room allows the volume of the tanks to be increased, which is very important, given the size of the tanks.

Another advantage of the invention consists in omitting all the lines for circulating the evaporated gas to the engine room or to any reliquefaction plant.

Finally, when the fluid refrigerant is nitrogen, a reserve of nitrogen is available in line with each tank and can be discharged into the ballast tanks to restrict the burnable-oxygen content in order to avoid a fire following an impact against the ballast tanks, for example when hit by another ship.

Although the invention has been described in conjunction with a particular embodiment, it is quite obvious that it is not in any way restricted thereto and that it comprises all technical equivalents of the means described and their combinations if these fall within the scope of the invention.

What is claimed is:

1. A process for preventing the evaporation of a mass of liquefied gas stored in an impervious and thermally insulated tank built into a bearing structure of a ship or located in a set of floating or land-side storage tanks, comprising the steps of:

immersing a hollow and open-ended pipe in the mass of liquefied gas;

passing a fluid refrigerant through a heat exchanger immersed in the mass of liquefied gas and partially enclosed by the pipe;

exchanging the heat within the mass of liquefied gas with the latent heat of the fluid refrigerant;

creating a temperature differential between opposite ends of the pipe;

generating a convective current in the mass of liquefied gas, using the temperature differential within the pipe, to increase the efficiency of the heat exchange; and cooling the mass of liquefied gas to a temperature below its reference storage temperature.

2. A process, according to claim 1, wherein said fluid refrigerant is liquid nitrogen.

3. A device for preventing the evaporation of a mass of liquefied gas stored in an impervious and thermally insulated tank built into a bearing structure of a ship or located in a set of floating or land-side storage tanks, comprising:

heat exchanger having a hairpin tube immersed within the mass of liquefied gas to exchange the heat of the mass of liquefied gas with the latent heat of a fluid refrigerant flowing through the heat exchanger;

a compressor for compressing the fluid refrigerant flowing out of the heat exchanger;

a refrigeration unit for cooling the compressed fluid refrigerant to a refrigeration temperature before the fluid refrigerant is provided to an input of the heat exchanger;

a pipe partially, enclosing the sides of the tube and having open ends, that forms a convective well to generate a convective flow in the mass of liquefied gas.

4. A device according to claim 3, further comprising a unit for circulating sea water to cool the compressed fluid refrigerant before it enters said refrigeration unit.

5. A device according to claim 4, wherein said sea water circulation unit is connected to a ballast collector of a ship.

6. Device according to claim 4, characterized in that the refrigerating unit is designed to take the fluid refrigerant down to a refrigeration temperature which is approximately 30° C. below the reference temperature for the mass of liquified gas before it enters the heat exchanger.

7. Device according to claim 3, characterized in that each tank is fitted with a pressure gauge for monitoring the variations in pressure in the volume of gas lying on top of the mass of liquified gas in the tank.

8. A device according to 3, wherein said fluid refrigerant is in the liquid phase as it enters said heat exchanger and vaporizes as it passes through the mass of liquefied gas, said refrigeration unit being designed to reliquefy the fluid refrigerant each cycle.

9. Device according to claim 8, characterized in that the refrigerating unit is designed to take the fluid refrigerant down to a refrigeration temperature which is approximately 30° C. below the reference temperature for the mass of liquified gas before it enters the heat exchanger.

10. A device according to claim 3, wherein said refrigeration unit is designed to take the fluid refrigerant down to a refrigeration temperature which is approximately 30° C. below the reference temperature for the mass of liquefied gas before it enters the heat exchanger.

11. A device according to claim 3, wherein each said tank is fitted with a pressure gage for monitoring the variations in pressure in the volume of gas lying on top of the mass of liquefied gas tank.

12. A device according to claim 11, wherein said pressure gage initiates the circulation of the fluid refrigerant as soon as the pressure detected by the pressure gage exceeds a first predetermined pressure threshold value above the reference storage pressure and stops circulation as soon as the detected pressure is below a second determined pressure threshold value below said reference storage pressure.

13. A device, according to claim 12, wherein said reference storage pressure is about 1,060 mmbar, wherein said first predetermined pressure threshold value is 5 mmbar above said reference storage pressure, and wherein said second predetermined pressure threshold value is 5 mmbar below said reference storage pressure.

14. A device according to 3, wherein said tank has at least one vertical transverse wall, said device further comprising a tower provided on one of said walls, wherein said heat exchanger is supported inside said tank by said tower for loading/offloading the liquefied gas.

15. A device according to claim 14, characterized in that the heat exchanger comprises one or more hairpin tubes, the ends of which pass through the roof of the tank.

16. A device according to claim 15, further comprising a vertically-oriented hollow pipe having open ends wherein said pipe is immersed within said liquified gas, said hollow pipe forming a convection well; wherein each said hairpin tube or group of said hairpin tubes is disposed within said convection well.

17. A device according to claim 14 wherein said compressor and said refrigeration unit are installed on the deck of the ship, in line with the loading/offloading towner of each tank.

18. A device, according to claim 3, wherein said fluid refrigerant is liquid nitrogen.

* * * * *